US009903295B2

(12) United States Patent
Wiehoff

(10) Patent No.: US 9,903,295 B2
(45) Date of Patent: Feb. 27, 2018

(54) METHOD FOR OPERATING AN INJECTION VALVE

(71) Applicant: Continental Automotive GmbH, Hannover (DE)

(72) Inventor: Hans-Joerg Wiehoff, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/105,668

(22) PCT Filed: Nov. 25, 2014

(86) PCT No.: PCT/EP2014/075504
§ 371 (c)(1),
(2) Date: Jun. 17, 2016

(87) PCT Pub. No.: WO2015/090859
PCT Pub. Date: Jun. 25, 2015

(65) Prior Publication Data

US 2016/0319760 A1 Nov. 3, 2016

(30) Foreign Application Priority Data

Dec. 20, 2013 (DE) ..... 10 2013 226 849

(51) Int. Cl.
*F02D 41/20* (2006.01)
*F02D 41/24* (2006.01)
(Continued)

(52) U.S. Cl.
CPC ..... *F02D 41/2096* (2013.01); *F02D 41/1402* (2013.01); *F02D 41/2467* (2013.01);
(Continued)

(58) Field of Classification Search
CPC ..... F02D 41/20; F02D 41/24; F02D 41/14; F02D 41/2096; F02D 41/1402;
(Continued)

(56) References Cited

U.S. PATENT DOCUMENTS 7,040,297 B2 5/2006 Baranowski et al. ..... 123/498
2002/0046734 A1* 4/2002 Rueger ..... F02D 41/2096 123/446
(Continued)

FOREIGN PATENT DOCUMENTS

DE 10143501 C1 5/2003 ..... F02D 41/20
DE 102008027585 A1 12/2009 ..... F02D 41/20
(Continued)

OTHER PUBLICATIONS

Raupach, C. et al., "Advanced Control of Piezo Injectors for Precise Fuel Injection," VDI Berichte, No. 1907, 12 pages (German language w/ English abstract), Jan. 1, 2005.
(Continued)

*Primary Examiner* — John Kwon
*Assistant Examiner* — Johnny H Hoang
(74) *Attorney, Agent, or Firm* — Slayden Grubert Beard PLLC

(57) ABSTRACT

The present disclosure relates to methods for operating an injection valve. An example method may include capturing ACTUAL quantities constituted by actuator current or actuator charge and/or actuator voltage continuously during an injection process; reconstructing a dynamic progression of the nozzle-needle stroke of an injection valve on the basis of a model structure for a motion of the nozzle needle of the injection valve, ascertaining the DESIRED quantities constituted by actuator current or actuator charge and/or actuator voltage therefrom, wherein the dynamic progression of the nozzle-needle stroke is reconstructed via a simplified
(Continued)

model structure by introduction of at least one discrete measured value pertaining to the injection valve into a basic model of the nozzle-needle motion; comparing the DESIRED quantities with the ACTUAL quantities; and minimizing the difference between the DESIRED quantities and the ACTUAL quantities.

6 Claims, 2 Drawing Sheets

(51) Int. Cl.
*F02M 65/00* (2006.01)
*F02D 41/14* (2006.01)

(52) U.S. Cl.
CPC ... *F02M 65/005* (2013.01); *F02D 2041/1433* (2013.01); *F02D 2041/2051* (2013.01); *F02D 2041/2055* (2013.01); *F02D 2041/2058* (2013.01)

(58) Field of Classification Search
CPC ..... F02D 41/2467; F02D 2041/1433; F02D 2041/2051; F02D 2041/2055; F02D 2041/2058; F02M 65/005
USPC ..... 123/445, 472, 490, 478–480, 299–301, 123/305; 701/102–104
See application file for complete search history.

(56) References Cited

U.S. PATENT DOCUMENTS

2005/0072854 A1* 4/2005 Baranowski ..... F02D 41/2096 239/5
2008/0125952 A1* 5/2008 Stoecklein ..... F02D 41/2096 701/103
2008/0129305 A1* 6/2008 Perryman ..... F02D 41/2096 324/511
2009/0277258 A1* 11/2009 Cueto ..... F02M 65/001 73/114.48
2009/0314073 A1* 12/2009 Perryman ..... F02D 41/2096 73/114.45
2012/0048239 A1* 3/2012 Jalal ..... F02D 41/2096 123/472
2012/0073361 A1* 3/2012 Cueto ..... F02M 65/001 73/114.45
2012/0101707 A1* 4/2012 Kemmer ..... F02D 41/20 701/103
2014/0346244 A1 11/2014 Russe et al. ..... 239/4

FOREIGN PATENT DOCUMENTS

DE 102008042146 A1 3/2010 ..... H02N 2/06
WO 2003/023212 A1 3/2003 ..... F02D 41/20
WO 2011/072293 A2 6/2011 ..... F02D 41/20
WO 2012/152552 A2 11/2012 ..... F02D 41/20
WO 2015/090859 A1 6/2015 ..... F02D 41/20

OTHER PUBLICATIONS

German Office Action, Application No. 102013226849.1, 4 pages, dated Jul. 23, 2014.
International Search Report and Written Opinion, Application No. PCT/EP2014/075504, 21 pages, dated May 8, 2015.
Korean Office Action, Application No. 2017047829846, 6 pages, dated Jul. 10, 2017.

* cited by examiner

METHOD FOR OPERATING AN INJECTION VALVE

CROSS-REFERENCE TO RELATED APPLICATIONS

This application is a U.S. National Stage Application of International Application No. PCT/EP2014/075504 filed Nov. 25, 2014, which designates the United States of America, and claims priority to DE Application No. 10 2013 226 849.1 filed Dec. 20, 2013, the contents of which are hereby incorporated by reference in their entirety.

TECHNICAL FIELD

The present disclosure relates to a method for operating an injection valve, and more specifically to driving the nozzle needle of an injector valve with a piezoelectric actuator.

BACKGROUND

With respect to injection valves for internal-combustion engines, very high requirements apply to the precision and robustness of the injection quantity under all operating conditions and over the entire service life of an associated motor vehicle. In order to achieve these objectives, control methods for the injection valves have been developed. In some cases, present-day control concepts utilize feedback signals from the piezoelectric actuator for the purpose of identifying individual static points of the nozzle-needle position during the actual injection process. In this connection, the piezoelectric actuator acts as a sensor. However, this information is subject to considerable disturbance-variable influences, because the piezoelectric actuator is used as an actuator and as a sensor at the same time. Moreover, these so-called signal-based approaches do not permit a statement about the dynamic behavior of the nozzle needle—that is to say, it is not possible to characterize paths of motion of the needle stroke. Consequently, the generation of absolute position values is not possible. But, in the case of injection valves that have no mechanical stop-points (for example, limitation of the nozzle-needle stroke by mechanical blocking), for precise actuation of the injection valve it is important to know the absolute position of the nozzle needle. This is decisive for a precise realization of demanded injection quantities.

Therefore, position values of nozzle needles can currently only be captured statically by utilizing piezoelectric effects (for example, coupling of force between nozzle needle and piezoelectric drive when closing the needle). These methods are subject to considerable disturbance-variable influences which can only be suppressed to a limited extent. In this connection, elaborate plausibility-checking methods find application which, however, under certain circumstances cannot filter out all possible characteristic cases and error cases and consequently result in remaining, impermissible residual errors.

Disturbance variables affecting the feedback signal are generated, inter alia, by the drive profile of the final stage, by the idle stroke in the transmission of force between piezoelectric actuator and nozzle needle, by friction effects in the region of the nozzle needle, and also by the actual stroke behavior of the piezoelectric actuator. The stated influences reduce the robustness of the derived controlled variables and consequently also have an effect on the quality of the control performance and ultimately on the quality of the injection quantity.

SUMMARY

The teachings of the present disclosure relate to operating an injection valve of the type described in the introduction, with which the progression of the nozzle-needle stroke can be ascertained particularly easily and precisely.

Some embodiments may include a method for operating an injection valve, the nozzle needle of which is driven by a piezoelectric actuator, characterized in that the dynamic progression of the nozzle-needle stroke is determined and controlled with the following steps:

- continuous capturing of the ACTUAL quantities constituted by actuator current or actuator charge and/or actuator voltage during an injection process;
- reconstructing the dynamic progression of the nozzle-needle stroke of an injection valve on the basis of a model structure for a motion of the nozzle needle of an injection valve, and ascertaining the DESIRED quantities constituted by actuator current or actuator charge and/or actuator voltage therefrom, wherein the dynamic progression of the nozzle needle-stroke is reconstructed via a simplified (reduced) model structure by introduction of at least one discrete measured value pertaining to the individual injection valve into a basic model of the nozzle-needle motion; and
- comparing the DESIRED quantities with the ACTUAL quantities, and minimizing the difference between the two quantities.

In some embodiments, the opening-time and/or closing-time of the nozzle needle is/are used as discrete measured value.

In some embodiments, internal variables of state for the actuator/needle stroke and/or the force acting on the actuator is/are ascertained via the model structure.

In some embodiments, the actuator speed and/or the actuator travel is/are ascertained as internal variables of state.

In some embodiments, the minimizing of the difference between the DESIRED quantities and ACTUAL quantities is carried out via an optimization algorithm.

The teachings of the present disclosure may be employed for the purpose of operating an injection valve with a nozzle needle driven directly by the piezoelectric actuator.

BRIEF DESCRIPTION OF THE DRAWINGS

The invention will be elucidated in detail in the following on the basis of an embodiment in conjunction with the drawing. Shown are.

DETAILED DESCRIPTION

Figure 1:
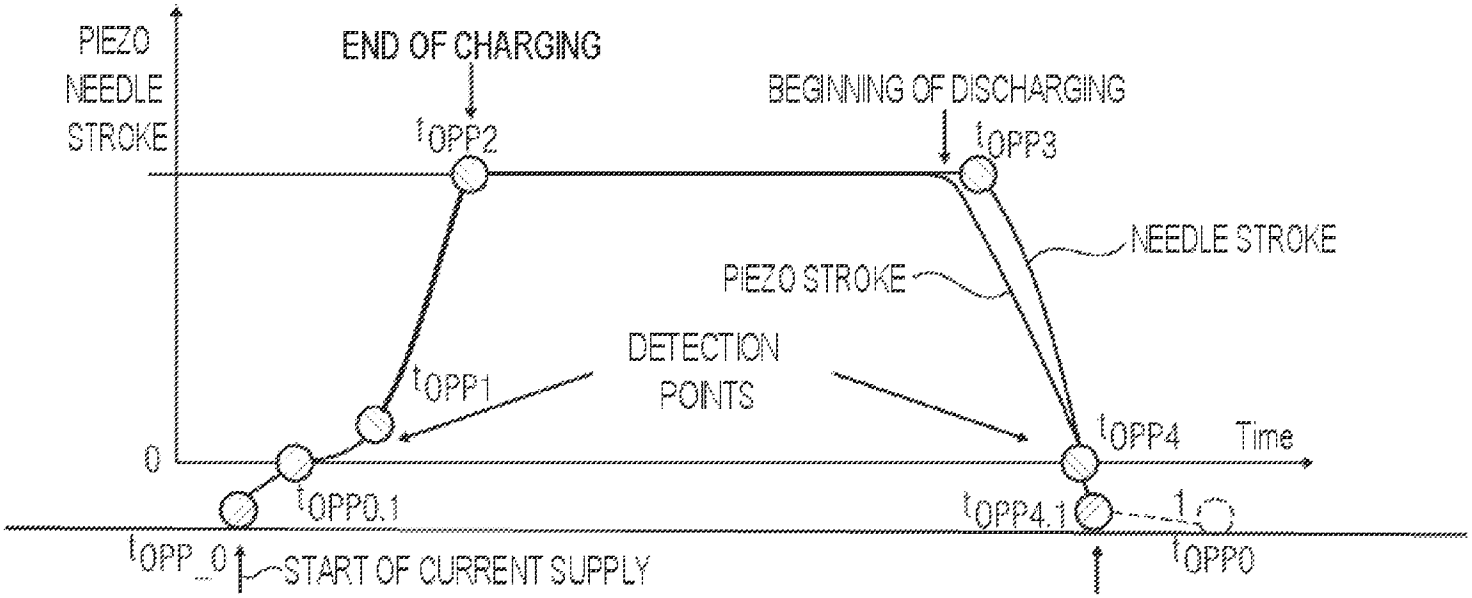
FIG. 1 a diagram that reproduces the piezo/needle stroke of an injection valve as a function of time.
Figure 2:
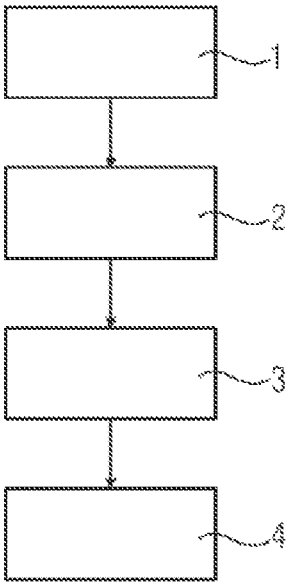
FIG. 2 a flow chart of a method for operating an injection valve.

According to the teachings of the present disclosure, a method may determine and control the dynamic progression of the nozzle-needle stroke with the following steps:

continuous capturing of the ACTUAL quantities constituted by actuator current or actuator charge and/or actuator voltage during an injection process;

reconstructing the dynamic progression of the nozzle-needle stroke of an injection valve on the basis of a model structure for a nozzle-needle motion of an injection valve, and ascertaining the DESIRED quantities constituted by actuator current or actuator charge and/or actuator voltage therefrom, wherein the dynamic progression of the nozzle-needle stroke is reconstructed via a simplified (reduced) model structure by introduction of at least one discrete measured value pertaining to the individual injection valve into a basic model of the nozzle-needle motion; and comparing the DESIRED quantities with the ACTUAL quantities and minimizing the difference between the two quantities.

In some embodiments, in contrast to the state of the art, certain quantities pertaining to the piezoelectric actuator are captured continuously and are compared with the quantities resulting from a model structure for a motion of the nozzle needle of an injection valve. The difference between these two quantities is ascertained and minimized, in order to control the progression of the nozzle-needle stroke.

In this connection, the physical quantities constituted by actuator current or actuator charge and/or actuator voltage are captured on a control device during the injection process, for example via an integrated measuring system. Moreover, the dynamic progression of the nozzle-needle stroke of an injection valve is reconstructed on the basis of a model structure for a motion of the nozzle needle of an injection valve. The information acquired from the sensor model is used in this case in the manner described above for correcting the real needle stroke and consequently guarantees a precise actuation of the injection valve.

The dynamic progression of the nozzle-needle stroke is reconstructed via a simplified (reduced) model structure by introduction of at least one discrete measured value pertaining to the individual injection valve into a basic model of the nozzle-needle motion. The starting-point is therefore a basic model that corresponds to a basic functionality of the needle motion of injection valves of such a type. This basic model is modified by introduction of at least one discrete measured value pertaining to the individual injection valve. By this means, an adjustment is made to the corresponding model of the injection valve. By way of discrete measured value in this connection, the opening-time and/or closing-time of the nozzle needle may be used.

In some embodiments, internal variables of state for the actuator/needle stroke and/or the force acting on the actuator, in particular the actuator speed and/or the actuator travel, is/are ascertained via the model structure. From these variables of state, the needle stroke for the simplified model formulation can then be ascertained.

The minimizing of the difference between the DESIRED quantities and ACTUAL quantities can be carried out, for example, via a suitable optimization algorithm, for example via a minimizing of the error area between the measured quantities or in weighted combination with derived quantities and with the corresponding quantities at the output of the model.

In some embodiments, a nozzle needle is driven directly by the piezoelectric actuator. But, in principle, the method can also be applied in the case of valves with indirect drive, for example in the case of injection valves with coil-actuated actuating elements and with servo injectors.

FIG. 1 shows, in a diagram, the progression of the piezo/needle stroke of an exemplary injection valve as a function of time. With the beginning of the supply of current, the needle stroke reaches the operating points $t_{OPP_0}$ (idle stroke), $t_{OPP0.1}$ (beginning of needle modulus (elasticity)) and $t_{OPP1}$ (opening of the needle). At $t_{OPP2}$ the maximum needle stroke has been attained. At $t_{OPP3}$ the process of closing the needle begins, which then has been completely closed at $t_{OPP4}$. At $t_{OPP4.1}$ the idle stroke has been overcome. The progression of the piezo stroke corresponds to that of the needle stroke up until the arrow represented, which marks the beginning of discharging. Starting from this point, the progression of the piezo stroke differs from that of the needle stroke. The two progressions meet again at point $t_{OPP4}$.

The points $t_{OPP1}$ (needle opening point) and $t_{OPP4}$ (needle completely closed), represented here, are detected and are introduced as discrete measured values into a basic model of the nozzle-needle motion.

Some embodiments include a method for operating an injection valve, the nozzle needle of which is driven by a piezoelectric actuator, wherein the dynamic progression of the nozzle-needle stroke is determined and controlled. In a first step 1, the actuator voltage of the piezoelectric actuator is captured continuously during an injection operation, by the actuator voltage being measured with a measuring system integrated into a control device. The corresponding measured values are stored, for example.

In another step (step 2), the dynamic progression of the nozzle-needle stroke of an injection valve is reconstructed on the basis of a model structure for a motion of the nozzle needle of the injection valve. In this case, the dynamic progression of the nozzle-needle stroke is reconstructed via a simplified (reduced) model structure by introduction of the opening-time and closing-time, detected for the current injection valve, of the nozzle needle into a basic model of the nozzle-needle motion. From this, the actuator voltage is ascertained as DESIRED quantity (step 2). The corresponding values can likewise be stored in the control device.

The currently measured actuator voltage (ACTUAL value) is then compared with the stored actuator voltage derived from the model structure (DESIRED/ACTUAL comparison) (see step 3), and the difference between the two quantities is minimized in step 4 for the purpose of dynamic control of the progression of the nozzle-needle stroke.

The aforementioned method contributes considerably to robust representation of injection processes and to increasing the quality of the injection quantity. By virtue of the precise determination of the needle motion, it is possible to construct extended control structures and to enhance the quality of the control performance significantly.

Figure 3:
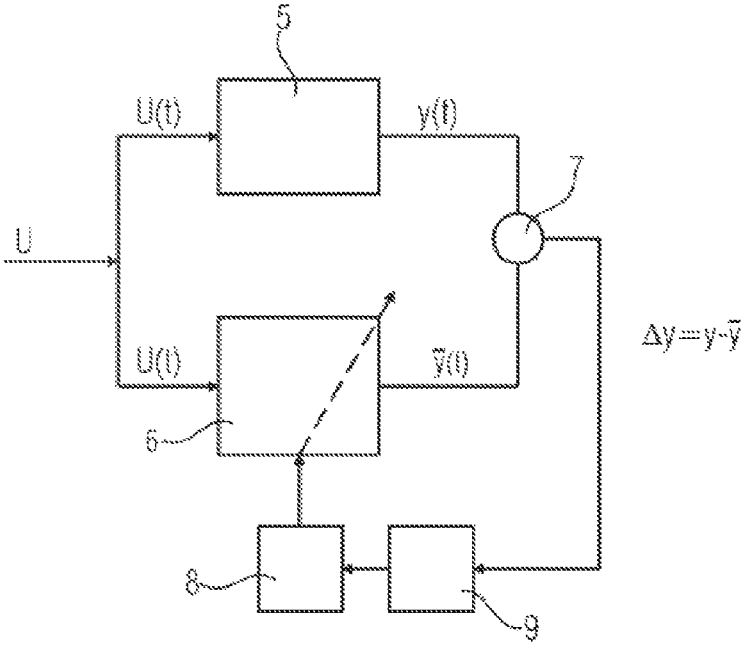
FIG. 3 a block diagram of the method represented in FIG. 2.

FIG. 3 shows a block diagram of the method described above. With the aid of the simplified model, indicated at 6, and the actuator voltage measured on the injection valve, indicated at 5, a modeled piezoelectric-actuator voltage $\bar{y}(t)$ and a measured piezoelectric-actuator voltage y(t) are obtained. The two voltages are compared with one another at 7, and the voltage difference $\Delta y = y - {}^{31} y$ is calculated. From the differential voltage, corresponding internal variables of state, such as piezoelectric motion and needle motion, inertia forces, speeds, are ascertained, as shown at 9. These values are subjected to an optimization strategy (step 8) and are then input into the system for the purpose of minimizing the voltage difference. The progression of the nozzle-needle stroke can be precisely controlled in this way.

What is claimed is:

1. A method for operating an injection valve having a nozzle-needle driven by a piezoelectric actuator, the method comprising:

capturing an ACTUAL quantity of a characteristic comprising at least one of the group consisting of: actuator current, actuator charge, and actuator voltage continuously during an injection process;

reconstructing a dynamic progression of the nozzle-needle stroke of the injection valve on the basis of a model structure for a motion of the nozzle needle of the injection valve, ascertaining a DESIRED quantity corresponding to the ACTUAL quantity captured, wherein the dynamic progression of the nozzle-needle stroke is reconstructed via a simplified model structure by introduction of at least one discrete measured value pertaining to the injection valve into a basic model of the nozzle-needle motion, the at least one discrete measured value including an internal variable of state chosen from the group consisting of: piezoelectric inertia forces, piezoelectric speeds, needle inertia forces, and needle speeds;

comparing the DESIRED quantities with the ACTUAL quantities; and minimizing the difference between the DESIRED quantities and the ACTUAL quantities.

2. The method as claimed in claim 1, wherein the at least one discrete measured value includes an opening time or a closing time of the nozzle-needle.

3. The method as claimed in claim 1, further comprising determining at least one of actuator speed or the actuator travel.

4. The method as claimed in claim 1, wherein minimizing the difference between the DESIRED quantities and ACTUAL quantities is carried out via an optimization algorithm.

5. The method as claimed in claim 1, wherein the nozzle needle is driven directly by the piezoelectric actuator.

6. A fuel injector for an internal combustion engine, the fuel injector comprising:

a nozzle-needle allowing fuel to flow into a combustion chamber of the internal combustion engine when the nozzle-needle is in an open position;

a piezoelectric actuator driving the nozzle-needle;

a sensor capturing at least one ACTUAL quantity comprising at least one quantity selected from the group consisting of actuator current, actuator charge, and actuator voltage continuously during an injection process;

a processor reconstructing a dynamic progression of the nozzle-needle stroke of an injection valve on the basis of a model structure for a motion of the nozzle needle of the injection valve, ascertaining DESIRED quantities corresponding to the at least one ACTUAL quantity, comparing the DESIRED quantities with the ACTUAL quantities; and minimizing the difference between the DESIRED quantities and the ACTUAL quantities;

wherein the dynamic progression of the nozzle-needle stroke is reconstructed via a simplified model structure by introduction of at least one discrete measured value pertaining to the injection valve into a basic model of the nozzle-needle motion, the at least one discrete measured value including an internal variable of state chosen from the group consisting of: piezoelectric inertia forces, piezoelectric speeds, needle inertia forces, and needle speeds.

* * * * *